US010825412B2

(12) United States Patent
Chen

(10) Patent No.: US 10,825,412 B2
(45) Date of Patent: Nov. 3, 2020

(54) LIQUID CRYSTAL PANEL INCLUDING GOA CIRCUIT AND DRIVING METHOD THEREOF

(71) Applicant: SHENZHEN CHINA STAR OPTOELECTRONICS TECHNOLOGY CO., LTD., Guangdong (CN)

(72) Inventor: Shuai Chen, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/322,044

(22) PCT Filed: Sep. 12, 2018

(86) PCT No.: PCT/CN2018/105166
§ 371 (c)(1),
(2) Date: Jan. 30, 2019

(87) PCT Pub. No.: WO2020/019426
PCT Pub. Date: Jan. 30, 2020

(65) Prior Publication Data

US 2020/0035180 A1 Jan. 30, 2020

(30) Foreign Application Priority Data

Jul. 27, 2018 (CN) ..... 2018 1 0839826

(51) Int. Cl.
*G09G 3/36* (2006.01)

(52) U.S. Cl.
CPC ..... *G09G 3/3677* (2013.01); *G09G 2310/08* (2013.01)

(58) Field of Classification Search
CPC ..... G09G 3/3677; G09G 2310/08
See application file for complete search history.

(56) References Cited

U.S. PATENT DOCUMENTS

2015/0371599 A1* 12/2015 Xiao ..... G09G 3/36 345/212
2016/0171949 A1* 6/2016 Dai ..... G11C 19/28 345/212

(Continued)

*Primary Examiner* — Aneeta Yodichkas
(74) *Attorney, Agent, or Firm* — Maschoff Brennan

(57) ABSTRACT

There is provided a liquid crystal panel including a GOA circuit and a driving method thereof. The GOA circuit includes a plurality of cascaded single-stage GOA circuit units, and each single-stage GOA circuit unit includes a first pull-down maintaining circuit unit and a second pull-down maintaining circuit unit. A first control terminal of the first pull-down maintaining circuit unit is input with a first clock signal, a second control terminal of the second pull-down maintaining circuit unit is input with a second clock signal, and the pull-down circuit unit is input with a scan driving signal of a GOA circuit unit of next second stage. The first clock signal and the second clock signal are input alternately to the pull-up circuit units and the pull-down circuit units in GOA circuit units of adjacent stages. The first clock signal and the second clock signal have the same long period.

10 Claims, 5 Drawing Sheets

(56) References Cited

U.S. PATENT DOCUMENTS

| | | | | |
|---|---|---|---|---|
| 2016/0189652 | A1* | 6/2016 | Xiao | H03K 17/6871 327/109 |
| 2016/0247442 | A1* | 8/2016 | Dai | G11C 19/287 |
| 2016/0284295 | A1* | 9/2016 | Dai | G09G 3/3648 |
| 2016/0284296 | A1* | 9/2016 | Dai | G09G 3/36 |
| 2016/0307532 | A1* | 10/2016 | Dai | G09G 3/36 |
| 2018/0268768 | A1* | 9/2018 | Lv | H01L 27/124 |

* cited by examiner

--Prior Art--

--Prior Art--

--Prior Art--

--Prior Art--

--Prior Art--

LIQUID CRYSTAL PANEL INCLUDING GOA CIRCUIT AND DRIVING METHOD THEREOF

TECHNICAL FIELD

The present disclosure relates to a display technical field, and more particularly, relates to a liquid crystal panel including a GOA (Gate Driver On Array) circuit and a driving method thereof.

BACKGROUND ART

A liquid crystal display has advantages of low radiation, small size, low power consumption and the like, and has been widely applied to a laptop computer, a personal digital assistant (PDA), a plat television or a mobile phone and other products. A manner of a traditional liquid crystal display is to display an image by using an external driving chip to drive a chip on a panel, but in order to reduce the number of elements and lower manufacturing costs, recently it gradually develops into directly manufacturing a driving circuit structure on a display panel, for example, adopting a GOA (Gate Driver On Array) technology.

The GOA technology is integrating a gate driving circuit of a TFT LCD (Thin Film Transistor Liquid Crystal Display) on a glass substrate, to form a scan driving for a liquid crystal panel. Compared with the traditional driving technology of using COF (Chip On Flex/Film), the GOA technology may greatly save manufacturing costs, and a Bonding process of the COF at a Gate side is omitted, which also extremely advantageous for productivity improvement. Thus, the GOA is a key technology in the future development of the liquid crystal panel.

The existing GOA circuit usually includes a plurality of cascaded single-stage GOA circuit units, and each single-stage GOA circuit unit corresponds to a scan driving line of the corresponding stage. For example, as shown in FIG. 1, the single-stage GOA circuit unit includes: a pull-up control circuit unit ①, a pull-up circuit unit ②, a down-delivering circuit unit ③, a pull-down circuit unit ④, a pull-down maintaining circuit unit ⑤ and a bootstrap capacitor ⑥. Referring to FIG. 1, the pull-up control circuit unit ① is mainly for implementing pre-charging for a pre-charging node Q(N), and usually, a down-delivering signal ST(N−1) and a scan driving signal G(N−1) transferred from a GOA circuit unit of the previous stage are input thereto. The pull-up circuit unit ② is mainly for rising a potential of the scan driving signal G(N). The down-delivering circuit unit ③ includes a thin film transistor, which mainly controls turning on and off of the pull-up control circuit unit in a next stage GOA circuit unit by outputting a down-delivering signal ST(N) of the present stage. The pull-down circuit unit ④ is mainly used for pulling potentials of the pre-charging node Q(N) and the scan driving signal G(N) down to a low power voltage VSS. The pull-down maintaining circuit unit ⑤ may include an inverter, which is mainly used for maintaining the potentials of the pre-charging node Q(N) and the scan driving signal G(N) at the low power voltage VSS, and a plurality of thin film transistors. The bootstrap capacitor ⑥ is mainly for providing and maintaining the potential of the pre-charging node Q(N), and this is helpful for the pull-up circuit unit ② to output the scan driving signal G(N).

The inverter of the pull-down maintaining circuit unit ⑤ may adopt a Darlington inverter, and a specific circuit structure thereof is shown in FIG. 2. The Darlington inverter may include four thin film transistors and has an input terminal Input and an output terminal Output. If a control signal LC is set to always be a high potential signal and the low power voltage VSS is set to always be a low potential signal, when the input terminal Input inputs a high potential signal, the output terminal Output outputs a low potential signal; and when the input terminal Input inputs a low potential signal, the output terminal Output outputs a high potential signal.

It is taken as an example to input two clock signals CK and XCK to the GOA circuit, when the pull-down maintaining circuit unit ⑤ includes the Darlington inverter, the single-stage GOA circuit unit is as shown in FIG. 3. In general, two pull-down maintaining circuit unit ⑤-1 and ⑤-2 may be disposed to work alternately in accordance with a waveform shown in FIG. 5, to prevent devices from being invalid due to serious forward drift of a threshold voltage Vth of thin film transistors caused for the reason that a Positive Bias Stress (PBS) is applied on thin film transistors T32, T42, T33 and T43 for a long time.

However, in the prior art, inputting two clock signals CK and XCK to the GOA circuit is still taken as an example, the liquid crystal panel adopting the GOA technology usually includes traces of the following signals: a common electrode signal Acom on an array substrate, a common electrode signal CFcom on a color filter, control signals LC1 and LC2, a start signal STV, a low power voltage VSS, and clock signals CK and XCK. As more and more functional structures are added to the circuit, space occupied by the GOA circuit is also bigger and bigger, and this is extremely disadvantageous for a design of a narrow bezel liquid crystal panel. Thus, how to reduce the number of signal lines and how to use the signal lines efficiently are extremely important for the future development of the liquid crystal panel.

SUMMARY

Exemplary embodiments of the present disclosure lie in providing a liquid crystal panel including a GOA circuit and a driving method thereof. A set of newly designed clock signals are input to the GOA circuit, and the set of clock signals may satisfy signal requirements of the pull-up circuit unit, and may also replace control signals in the pull-down maintaining circuit unit, thereby using clock signal lines efficiently and saving the space occupied by wiring in a display panel efficiently, to provide a new possibility for the design of the future GOA circuit.

One aspect of the present disclosure provides a liquid crystal panel including a GOA circuit, the GOA circuit includes a plurality of cascaded single-stage GOA circuit units, wherein each single-stage GOA circuit unit comprises a pull-up control circuit unit, a pull-up circuit unit, a pull-down circuit unit, a bootstrap capacitor, a down-delivering circuit unit, a first pull-down maintaining circuit unit, and a second pull-down maintaining circuit unit, wherein in each single-stage GOA circuit unit, a first control terminal of the first pull-down maintaining circuit unit is configured to receive a first clock signal, a second control terminal of the second pull-down maintaining circuit unit is configured to receive a second clock signal, and the pull-down circuit unit is configured to receive a scan driving signal from a GOA circuit unit of a next second stage, wherein the pull-up circuit units in GOA circuit units of two adjacent stages are configured to receive the first clock signal and the second clock signal alternately, wherein the first clock signal and the second clock signal have the same long period, and wherein the second clock signal delays with respect to the first clock signal, so that the second clock signal has a high potential at a first time period and a third time period within each high potential time period of the first clock signal, and has a low potential at a second time period between the first time period and the third time period.

According to the exemplary embodiments, the first pull-down maintaining circuit unit may comprise: a first inverter having a first input terminal, a first output terminal and a first control terminal, wherein the first input terminal is connected to a pre-charging node, and the first output terminal is connected to gates of a sixth thin film transistor and a seventh thin film transistor; the sixth thin film transistor of which the gate is connected to a gate of the seventh thin film transistor, a drain is connected to a low power voltage line, and a source is connected to a scan driving line of the present stage; and the seventh thin film transistor of which the gate is connected to the gate of the sixth thin film transistor, a drain is connected to the low power voltage line, and a source is connected to the pre-charging node.

According to the exemplary embodiments, the second pull-down maintaining circuit unit may comprise: a second inverter including a second input terminal, a second output terminal and a second control terminal, wherein the second input terminal is connected to the pre-charging node, and the second output terminal is connected to gates of an eighth thin film transistor and a ninth thin film transistor; the eighth thin film transistor of which the gate is connected to the gate of the ninth thin film transistor, a drain is connected to the low power voltage line, and a source is connected to the scan driving line of the present stage; and the ninth thin film transistor of which the gate is connected to the gate of the eighth thin film transistor, a drain is connected to the low power voltage line, and a source is connected to the pre-charging node.

According to the exemplary embodiments, the pull-down circuit unit may comprise: a fourth thin film transistor of which a gate is connected to a gate of a fifth thin film transistor and is configured to receive the scan driving signal from the GOA circuit unit of next second stage, a drain is connected to the low power voltage line, and a source is connected to the scan driving line of the present stage; and a fifth thin film transistor of which the gate is connected to the gate of a fourth thin film transistor and is configured to receive the scan driving signal from the GOA circuit unit of next second stage, a drain is connected to the low power voltage line, and a source is connected to the pre-charging node.

According to the exemplary embodiments, the pull-up circuit unit may comprise: a second thin film transistor of which a drain is connected to the down-delivering circuit unit and is configured to receive the first clock signal or the second clock signal, a gate is connected to a pre-charging node, and a source is connected to a scan driving line of the present stage to output a scan driving signal.

According to the exemplary embodiments, the down-delivering circuit unit may comprise: a third thin film transistor of which a drain is connected to the pull-up circuit unit and is configured to receive the first clock signal or the second clock signal, a gate is connected to a pre-charging node, and a source is connected to a stage-shift signal line of the present stage to output a stage-shift signal.

Another aspect of the present disclosure provides a method of driving a liquid crystal panel including a GOA circuit, the GOA circuit comprising a plurality of cascaded single-stage GOA circuit units, wherein each single-stage GOA circuit unit comprises a pull-up control circuit unit, a pull-up circuit unit, a pull-down circuit unit, a bootstrap capacitor, a down-delivering circuit unit, a first pull-down maintaining circuit unit and a second pull-down maintaining circuit unit, and the method comprises: inputting a first clock signal to a first control terminal of the first pull-down maintaining circuit unit, inputting a second clock signal to a second control terminal of the second pull-down maintaining circuit unit, and inputting the first clock signal and the second clock signal alternately to the pull-up circuit units in GOA circuit units of two adjacent stages; in a scan outputting time period, the pull-up circuit unit outputting the first clock signal or the second clock signal to a scan driving line of the present stage to output a scan driving signal; in a reset time period, the pull-down circuit unit be input with a scan driving signal from a GOA circuit unit of next second stage to reset potentials of a pre-charging node and the scan driving signal; in a low potential maintaining period, the first pull-down maintaining circuit unit and the second pull-down maintaining circuit unit work alternately to maintain low potentials of the scan driving signal and the pre-charging node, wherein the first clock signal and the second clock signal have the same long period, and wherein the second clock signal delays with respect to the first clock signal, so that the second clock signal has a high potential at a first time period and a third time period within each high potential time period of the first clock signal, and has a low potential at a second time period between the first time period and the third time period.

According to the exemplary embodiments, the first time period may be a start time period of the first clock signal and an end time period of a previous high potential time period of the second clock signal, the second time period is a middle time period of the first clock signal and a low potential time period of the second clock signal, and the third time period is an end time period of the first clock signal and a start time period of a next high potential time period of the second clock signal.

According to the exemplary embodiments, a duty ratio of each of the first clock signal and the second clock signal may be 60/40.

According to the exemplary embodiments, the first time period and the third time period may respectively occupy 10% of each period.

BRIEF DESCRIPTION OF THE DRAWINGS

The above and/or other aspects and advantages of the disclosure will become apparent from the following description of the embodiments, taken in conjunction with the accompanying drawings in which.

DETAILED DESCRIPTION OF EXEMPLARY EMBODIMENT

Figure 1:
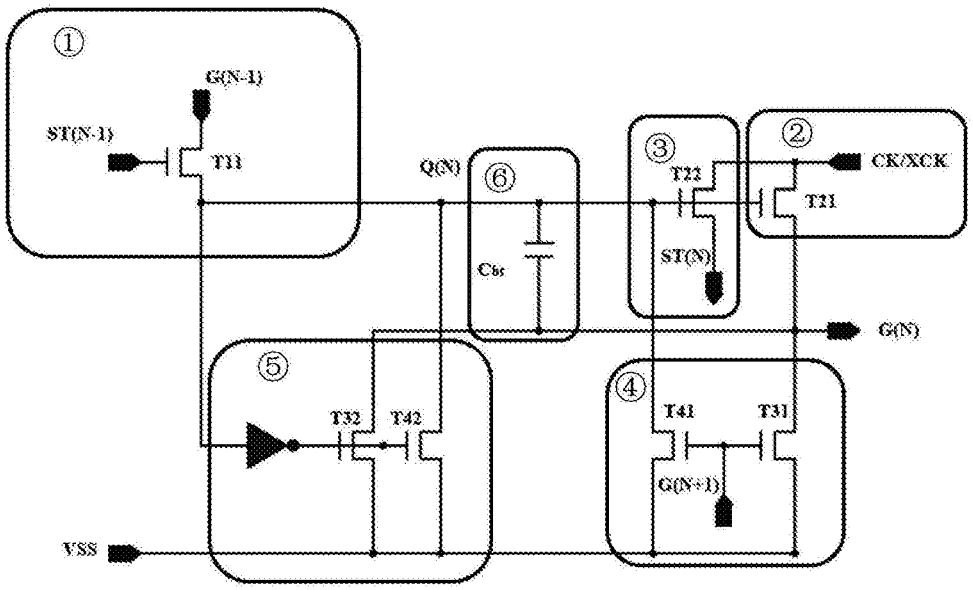
FIG. 1 is a schematic diagram of a single-stage GOA circuit unit in the prior art.

Now, one or more exemplary embodiments of the present disclosure will be described in more details by referring to the accompanied drawings. The same reference numeral may be used to indicate identical or corresponding components, and repeated explanations are omitted.

The terms used herein are only for the purpose of describing a purpose of a specific exemplary embodiment, with no intention to limit the concept of the present disclosure. As used herein, unless additionally specified in the context clearly, a singular form of "a/an" and "said (the)" also intentionally includes a plural form. It should also be understood that, when the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Figure 4:
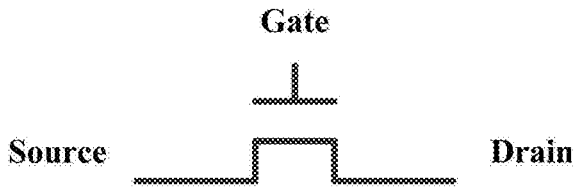
FIG. 4 is an equivalent circuit diagram of a thin film transistor.

To facilitate the succeeding understanding, basic elements will be explained firstly. A GOA circuit according to an exemplary embodiment of the present disclosure may include a plurality of thin film transistors. FIG. 4 is an equivalent circuit diagram of a thin film transistor, three electrodes of the thin film transistor refer to a gate Gate, a source Source, and a drain Drain, respectively. Accordingly, voltages applied on the respective electrodes may be marked as Vg, Vs, and Vd, respectively. Here, there is no difference between the source Source and the drain Drain actually, but in order to facilitate explanation, one end with a lower voltage is usually referred to the source, and the other end with a higher voltage is referred to the drain in the exemplary embodiment. Thus, a voltage Vgs is used to determine a on state of the thin film transistor wherein Vgs=Vg−Vs, when Vgs>0, the thin film transistor is in the on state, and a current flows to the source Source from the drain Drain; when Vgs=0, the thin film transistor is in a weak on state, and a current flows to the source Source from the drain Drain; and when Vgs<0, the device is in a off state. Alternatively, in other exemplary embodiments, one end with a lower voltage may also be referred to a drain Drain, and the other end with a high voltage may be referred to a source Source, that is, when the thin film transistor is in the on state, a current flows to the drain Drain from the source Source.

Figure 3:
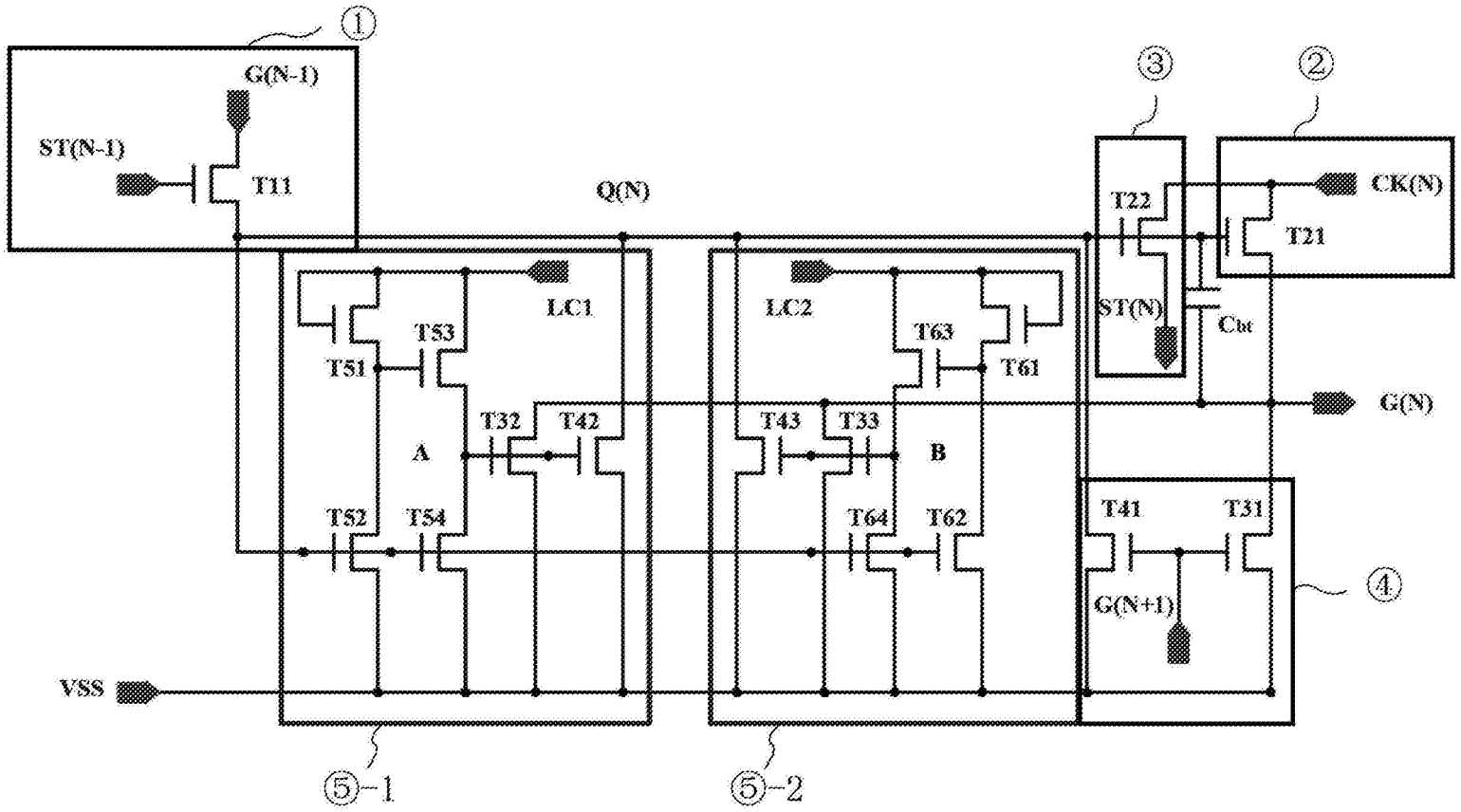
FIG. 3 is a schematic diagram of a single-stage GOA circuit unit in the prior art.
Figure 5:
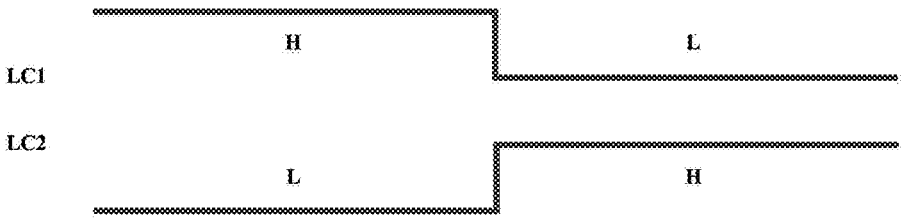
FIG. 5 is a waveform diagram of control signals of two pull-down maintaining circuit units in FIG. 3.

FIG. 5 is a waveform diagram of control signals LC1 and LC2 of two pull-down maintaining circuit units ⑤-1 and ⑤-2 in FIG. 3. The principle that the two pull-down maintaining circuit units ⑤-1 and ⑤-2 work alternately will be explained below by referring to FIG. 3 and FIG. 5.

Taking an Nth stage of GOA circuit unit as an example, when a scan driving signal G(N) is maintained at a low potential time period (i.e., a low potential maintaining time period), a pre-charging node Q(N) is always in a low potential time period, that is, thin film transistors T52, T54, T62 and T64 are all turned off.

When the first control signal LC1 is at a high potential and the second control signal LC2 is at a low potential, the pull-down maintaining circuit unit ⑤-1 is in a working state, and thin film transistors T51 and T53 are turned on. At this time, a first node A is at a high potential, and a Positive Bias Stress (PBS) is applied on thin film transistors T32 and T42, that is, the thin film transistors T32 and T42 are turned on, so that a low power voltage VSS is transmitted to the pre-charging node Q(N) and a scan driving line of the present stage through the thin film transistors T42 and T32, respectively, to maintain the low potentials of the pre-charging node Q(N) and the scan driving signal G(N). However, the pull-down maintaining circuit unit ⑤-2 is accordingly in a non-working state at this time, thin film transistors T61 and T63 are in a weak on state (i.e., Vgs=0), a second node B is at a low potential, and a Negative Bias Stress (NBS) is applied on thin film transistors T33 and T43, that is, the thin film transistors T33 and T43 are turned off.

Similarly, when the first control signal LC1 is at a low potential and the second control signal LC2 is at a high potential, the pull-down maintaining circuit unit ⑤-2 is in a working state, and thin film transistors T61 and T63 are turned on. At this time, the second node B is at a high potential, and the PBS is applied on the thin film transistors T33 and T43, that is, the thin film transistors T33 and T43 are turned on, so that the low power voltage VSS is transmitted to the pre-charging node Q(N) and the scan driving line of the present stage through the thin film transistors T43 and T33, respectively, to maintain the low potentials of the pre-charging node Q(N) and the scan driving signal G(N). However, the pull-down maintaining circuit unit ⑤-1 is accordingly in the non-working state at this time, the thin film transistors T51 and T53 are in a weak on state (i.e., Vgs=0), the first node A is at a low potential, the PBS is applied on the thin film transistors T32 and T42, that is, the thin film transistors T32 and T42 are turned off.

Thus, in a period of time, the pull-down maintaining circuit units ⑤-1 and ⑤-2 work alternately to maintain the low potentials of the pre-charging node Q(N) and the scan driving signal G(N), the PBS and the NBS both are applied on the thin film transistors T32 and T42 according to a potential change of the first node A. Similarly, the PBS and the NBS both are applied on the thin film transistors T33 and T43 according to a potential change of the second node B, thus, a device failure caused due to charge trapping may be relieved to a certain degree.

Figure 6:
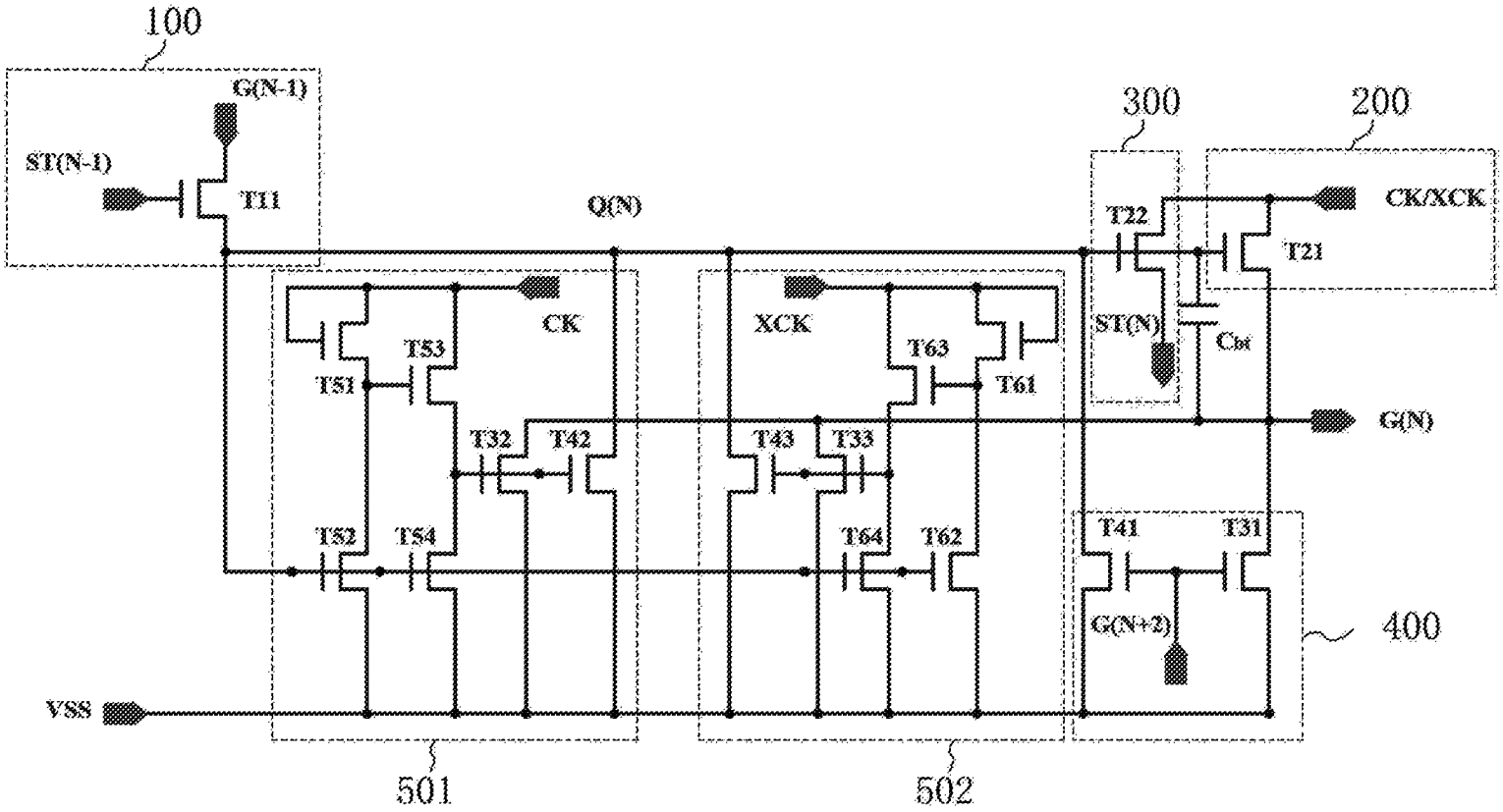
FIG. 6 is a schematic diagram of a single-stage GOA circuit unit according to an exemplary embodiment of the present disclosure.
Figure 7:
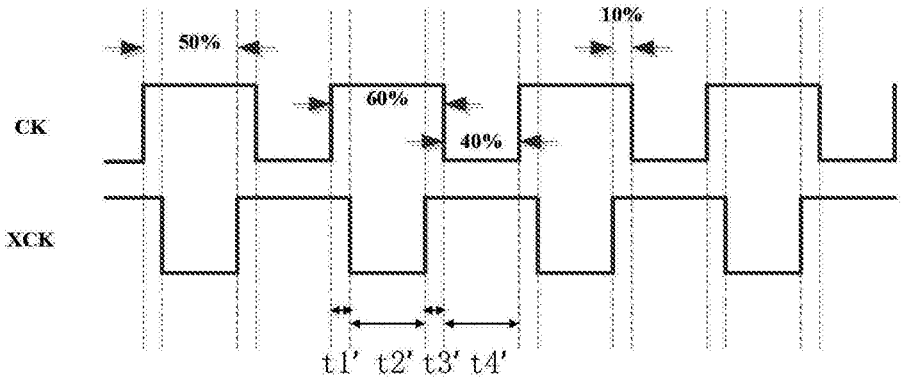
FIG. 7 is a waveform diagram of clock signals according to an exemplary embodiment of the present disclosure.

FIG. 6 is a schematic diagram of a single-stage GOA circuit unit according to an exemplary embodiment of the present disclosure. FIG. 7 is a waveform diagram of clock signals according to an exemplary embodiment of the present disclosure.

As shown in FIG. 6, a GOA circuit of the liquid crystal panel including the GOA circuit according to the exemplary embodiment of the present disclosure includes a plurality of cascaded single-stage GOA circuit units, wherein each single-stage GOA circuit unit includes: a pull-up control circuit unit 100, a pull-up circuit unit 200, a down-delivering circuit unit 300, a pull-down circuit unit 400, a bootstrap capacitor Cbt, a first pull-down maintaining circuit unit 501 and a second pull-down maintaining circuit unit 502.

Referring to FIG. 6, in each single-stage GOA circuit unit, a first clock signal CK is input to a first control terminal of the first pull-down maintaining circuit unit 501, a second clock signal XCK is input to a second control terminal of the second pull-down maintaining circuit unit 502, a scan driving signal of a GOA circuit unit of next second stages are input to the pull-down circuit unit 400, and the first clock signal CK and the second clock signal XCK are input alternately to the pull-up circuit unit 200 and the down-delivering circuit unit 300 in GOA circuit units of adjacent stages. Referring to FIG. 7, the first clock signal CK and the second clock signal XCK have the same long time period, and the second clock signal XCK delays with respect to the first clock signal CK, so that the second clock signal XCK has a high potential at a first time period t1' and a third time period t3' within each high potential time period of the first clock signal CK, and has a low potential at a second time period t2' between the first time period t1' and the third time period t3'.

According to the exemplary embodiment of the present disclosure, each single-stage GOA circuit unit of the liquid crystal panel may be driven by the first clock signal CK and the second clock signal XCK, that is, the first clock signal CK and the second clock signal XCK may replace the control signals LC1 and LC2 in the pull-down maintaining circuit unit, and may satisfy the signal requirement of the pull-up circuit unit, reduce the number of signal lines and use the signal lines efficiently, thereby saving space occupied by wiring in a display panel.

Hereinafter, a structure of an Nth (N is a natural number bigger than or equal to 1) stage of GOA circuit unit will be takes as an example to particularly explain, with reference to FIG. 6, and that other stages of GOA circuit units have similar structures.

In exemplary embodiment of the present disclosure, the thin film transistor included in the GOA circuit may be a high potential turned-on thin film transistor, for example, a high potential turned-on a-Si thin film transistor or an NMOS transistor. However, the inventive concept is not limited hereto, in other exemplary embodiments, the thin film transistor included in the GOA circuit may also be a low potential turned-on a-Si thin film transistor, such as a PMOS thin film transistor. In order to facilitate explanation, it will be described hereinafter to take all thin film transistors being high potential turned-on NMOS transistors as an example.

In the Nth stage of GOA circuit unit, the pull-up control circuit unit 100 may include: a first thin film transistor T11 of which a gate is input with a stage-shift signal ST(N−1) of a GOA circuit unit of the previous stage, a drain is input with a scan driving signal G(N−1) of the GOA circuit unit of the previous stage, and a source is connected to a pre-charging node Q(N).

The pull-up circuit unit 200 may include: a second thin film transistor T21 of which a drain is input with the first clock signal CK or the second clock signal XCK, a gate is connected to a pre-charging node Q(N), and a source is connected to a scan driving line of the present stage to output a scan driving signal G(N). The pull-up circuit unit 200 is mainly used for raising a potential of the scan driving signal G(N).

The down-delivering circuit unit 300 may include: a third thin film transistor T22 of which a drain is input with the first clock signal CK or the second clock signal XCK (that is, the clock signals are the same as those input to the gate of the second thin film transistor T21 of the present stage), a gate is connected to a pre-charging node Q(N), and a source is connected to a stage-shift line of the present stage to output a stage-shift signal ST(N).

It is taken as an example to use two clock signals CK and XCK in the GOA circuit, and the first clock signal CK and the second clock signal XCK are input alternately to the GOA circuits of the adjacent stages, that is, the first clock signal CK and the second clock signal XCK are input alternately to the pull-up circuit units 200 and the down-delivering circuit units 300 in the GOA circuit units of the adjacent stages. In particular, according to the exemplary embodiments of the present disclosure, when the first clock signal CK is input to the pull-up circuit unit 200 and the down-delivering circuit unit 300 in the Nth stage of GOA circuit unit, the second clock signal XCK is input to the pull-up circuit unit 200 and the down-delivering circuit unit 300 in the (N+1)th stage of GOA circuit unit, the first clock signal CK is input to the pull-up circuit unit 200 and the down-delivering circuit unit 300 in the (N+2)th stage of GOA circuit unit, and the second clock signal XCK is input to the pull-up circuit unit 200 and the down-delivering circuit unit 300 in the (N+3)th stage of GOA circuit unit, and so on. However, the concept of the present disclosure is not limited hereto, in other exemplary embodiments, the second clock signal XCK may be input to the pull-up circuit unit 200 and the down-delivering circuit unit 300 in the Nth stage of GOA circuit unit, and the first clock signal CK may be input to the pull-up circuit unit 200 and the down-delivering circuit unit 300 in the (N+1) stage of GOA circuit unit, and so on. On the other hand, for example, the first clock signal CK may be input to the pull-up circuit units 200 and the down-delivering circuit units 300 in odd stages of GOA circuit units, and the second clock signal XCK may be input to the pull-up circuit units 200 and the down-delivering circuit units 300 in even stages of GOA circuit units, and vice versa.

The bootstrap capacitor Cbt uses a characteristic that voltages of two ends of a capacitor cannot change suddenly, when the two ends of the capacitor are maintained with a certain voltage, if a voltage of a negative end of the capacitor is raised, a voltage of a positive end thereof still maintains a difference with an initial voltage of the negative end, and it corresponds to that the voltage of the positive end is booted by the negative end. As shown in FIG. 6, one end of the bootstrap capacitor Cbt may be connected to the pre-charging node Q(N), and the other end thereof may be connected to the scan driving line of the present stage. The bootstrap capacitor Cbt is mainly used for maintaining and raising the potential of the pre-charging node Q(N).

The pull-down circuit unit 400 may include a fourth thin film transistor T31 and a fifth thin film transistor T41 of which gates are connected with each other, and it is different from that the pull-down circuit unit is input with the scan driving signal G(N+1) of the (N+1)th stage of GOA circuit unit as shown in FIG. 3, the gates of the fourth thin film transistor T31 and the fifth thin film transistor T41 may be input with a scan driving signal G(N+2) of a GOA circuit unit of next second stages (i.e., a (N+2)th stage). The drain of the fourth thin film transistor T31 may be connected to a low power voltage line, and a source thereof may be connected to a scan driving line of the present stage. In addition, the drain of the fifth thin film transistor T41 may be connected to the low power voltage line, and a source thereof may be connected to the pre-charging node Q(N). The pull-down circuit unit 400 is mainly used for pulling potentials of the pre-charging node Q(N) and the scan driving signal G(N) down to a low power voltage VSS.

Figure 2:
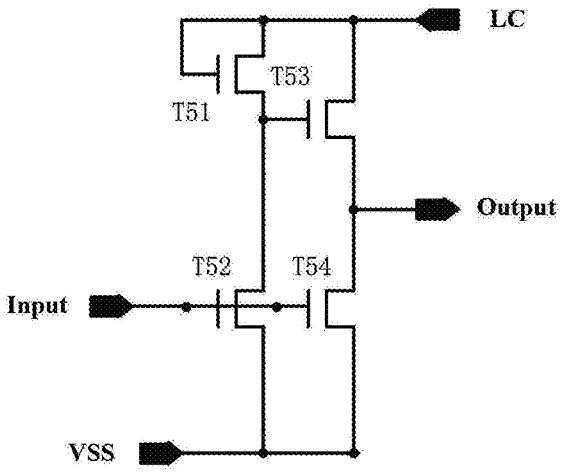
FIG. 2 is a circuit diagram of a Darlington inverter included in a pull-down maintaining circuit unit in FIG. 1.

In the exemplary embodiments of the present disclosure, the inverter included in the pull-down maintaining circuit unit may be a Darlington inverter, which may have a structure as shown in FIG. 2, but the inventive concept is not limited hereto. In order to facilitate explanation, it will be described hereinafter to take the Darlington inverter as an example.

Referring to FIG. 6, the first down-delivering circuit unit 501 may include: a first inverter having a first input terminal Input, a first output terminal Output (corresponding to the first node A) and a first control terminal, wherein the first input terminal Input may be connected to a pre-charging node Q(N), the first output terminal Output may be connected to gates of a sixth thin film transistor T32 and a seventh thin film transistor T42; the sixth thin film transistor T32 of which a gate may be connected to the gate of the seventh thin film transistor T42, a drain may be connected to the low power voltage line VSS, and a source may be connected to the scan driving line of the present stage; and the seventh thin film transistor T42 of which a gate may be connected to the gate of the sixth thin film transistor T32, a drain is connected to the low power voltage line VSS, and a source is connected to the pre-charging node Q(N).

Similarly, the second down-delivering circuit unit 502 may include: a second inverter including a second input terminal Input, a second output terminal Output (corresponding to the second node B) and a second control terminal, wherein the second input terminal Input may be connected to a pre-charging node, the second output terminal Output may be connected to gates of an eighth thin film transistor T33 and a ninth thin film transistor T43; the eighth thin film transistor T33 of which the gate may be connected to the gate of the ninth thin film transistor T43, a drain may be connected to the low power voltage line VSS, and a source may be connected to the scan driving line of the present stage; and the ninth thin film transistor T43 of which a gate may be connected to a gate of the eighth thin film transistor T33, a drain may be connected to the low power voltage line VSS, and a source may be connected to the pre-charging node Q(N).

Except that the second control terminal is input with the second clock signal XCK, the second pull-down maintaining circuit unit 502 may have the same circuit structure as that of the first pull-down maintaining circuit unit 501. The pull-down maintaining circuit units 501 and 502 are mainly used for maintaining potentials of the pre-charging node Q(N) and the scan driving signal G(N) at the low power voltage VSS.

FIG. 7 is a waveform diagram of clock signals according to an exemplar embodiment of the present disclosure.

As shown in FIG. 7, the first clock signal CK and the second clock signal XCK have the same long period. Taking one period as an example, one period of each of the first clock signal CK and the second clock signal XCK may include a first time period t1', a second time period t2', a third time period t3' and a fourth time period t4'. In addition, the first clock signal Ck and the second clock signal XCK may be square-wave pulse signals, each period of them may be formed by a high potential time period and a low potential time period.

According to the exemplary embodiments of the present disclosure, the second clock signal XCK delays with respect to the first clock signal CK, so that the second clock signal XCK has a high potential at a first time period t1' and a third time period t3' within each high potential time period of the first clock signal CK, and has a low potential at a second time period t2' between the first time period t1' and the third time period t3'.

In one exemplary embodiment, as for each high potential time period of the first clock signal CK, the first time period t1' may be a start time period of the first clock signal CK and an end time period of a previous high potential time period of the second clock signal XCK, the second time period t2' may be a middle time period of the first clock signal CK and a low potential time period of the second clock signal XCK, and the third time period t3' may be an end time period of the first clock signal CK and a start time period of a next high potential time period of the second clock signal XCK.

According to the exemplary embodiments of the present disclosure, each of high potential time of the first clock signal CK and the second clock signal XCK may occupy 60% of one period thereof, and each of low potential time thereof may occupy 40% of one period thereof. That is, a duty ratio of each of the first clock signal CK and the second clock signal XCK may be 60/40.

In one exemplary embodiment, the first time period t1' and the third time period t3' may be spaced from each other, and they may occupy 10% of each period respectively. The second time period t2' and the fourth time period t4' may occupy 40% of one period respectively. The first clock signal CK and the second clock signal XCK may be completely inverted during the second time period t2' and the fourth time period t4'.

Alternatively, according to the exemplary embodiments of the present disclosure, the duty ratios of high and low potentials (i.e., a ratio of the high potential time to the low potential time) of the first clock signal CK and the second clock signal XCK may be other proportions, for example, 50/50, 70/30, 80/20, and the like. The time in one period occupied by the first time period t1' and the third time period t3' respectively may also be other proportions, for example, 5%, 20%, and the like.

Returning to refer to FIG. 6, when the pre-charging node Q(N) is at the high potential (not shown), according to the principle of the Darlington inverter, the first output terminal (i.e., the first node A) of the first inverter and the second output terminal (i.e., the second node B) of the second inverter both are at the low potential, and the thin film transistors T32, T42, T33, and T43 are all turned off, and at this time, the pull-down maintaining circuit units 501 and 502 both do not work. However, in the low potential maintaining period, the pre-charging node Q(N) is at the low potential, the thin film transistors T52, T54, T62, and T64 are all turned off, and at this time, the pull-down maintaining circuit units 501 and 502 work alternately to maintain the low potential of the scan driving signal G(N). The principle of working alternately will be explained below in conjunction with FIG. 6 and FIG. 7.

During the first time period t1', the first clock signal CK is at a high potential, and the second clock signal XCK is also at the high potential. At this time, the first node A as the first output terminal of the first inverter and the second node B as the second output terminal of the second inverter both are at the high potential, the thin film transistors T32, T42, T33 and T43 are all turned on, the pull-down maintaining circuit units 501 and 502 both are in a working state, the low power voltage VSS may be transmitted to the pre-charging node Q(N) and the scan driving line of the present stage to maintain the low potentials of the pre-charging node Q(N) and the scan driving signal G(N).

During the second time period t2', the first clock signal CK is still at the high potential, and the second clock signal XCK is changed to be at a low potential. At this time, the first node A as the first output terminal of the first inverter may be at a high potential, the thin film transistors T32 and T42 are turned on, the first pull-down maintaining circuit unit 501 may be in a working state, the low power voltage VSS may be transmitted to the pre-charging node Q(N) and the scan driving line of the present stage to maintain the low potentials of the pre-charging node Q(N) and the scan driving signal G(N). However, since the second node B as the second output terminal of the second inverter is at the low potential at this time, thus, the thin film transistors T33 and T43 are turned off, and the second pull-down maintaining circuit unit 502 does not work.

During the third time period t3', the first clock signal CK is still at the high potential, and the second clock signal XCK is changed to be at a high potential. At this time, the first node A as the first output terminal of the first inverter and the second node B as the second output terminal of the second inverter both are at the high potential, the thin film transistors T32, T42, T33 and T43 are all turned on, the pull-down maintaining circuit units 501 and 502 both are in a working state, and the low power voltage VSS may be transmitted to the pre-charging node Q(N) and the scan driving line of the present stage, to maintain the low potentials of the pre-charging node Q(N) and the scan driving signal G(N).

During the fourth time period t4', the first clock signal CK is changed to be at a low potential, and the second clock signal XCK is still at the high potential. At this time, the first node A as the first output terminal of the first inverter may be at a low potential, the thin film transistors T32 and T42 are turned off, and the first pull-down maintaining circuit unit 501 does not work; while the second node B as the second output terminal of the second inverter is at a high potential, the thin film transistors T33 and T43 are turned on, the second pull-down maintaining circuit unit 502 is in a working state, and the low power voltage VSS may be transmitted to the pre-charging node Q(N) and the scan driving line of the present stage, to maintain the low potentials of the pre-charging node Q(N) and the scan driving signal G(N).

In the prior art, since two pull-down maintaining circuit units work alternately, it usually adopts completely inverted control signals LC1 and LC2 shown in FIG. 5, and at a time when the two pull-down maintaining circuit units work alternately, the control signals LC1 and LC2 belong to high frequency alternating current signals, a situation that the signals delay may occur under the function of resistance-capacitance, that is, a situation that the signals may change gradually to a certain degree may occur, and it may cause the scan driving signal G(N) to be disconnected or the potential to be unstable.

The present disclosure solves the above technical problem well. According to the exemplary embodiments of the present disclosure, the clock signals CK and XCK are set to have the time periods which are at the high potential (i.e., the first time period t1' and the third time period t3'), for example, referring to FIG. 7, at a time period (e.g., the first time period t1') when the working state of the second pull-down maintaining circuit unit 502 is coming to an end, the first pull-down maintaining circuit unit 501 starts to enter the working state; at a time period (i.e., the third time period t3') when the working state of the first pull-down maintaining circuit unit 501 is coming to an end, the second pull-down maintaining circuit unit 502 starts to enter the working state, thereby ensuring that the pull-down maintaining circuit units 501 and 502 work normally and alternately, and stably maintaining the low potentials of the pre-charging node Q(N) and the scan driving signal G(N), without causing the scan driving signal G(N) to be disconnected or the potential to be unstable.

In addition, according to the exemplary embodiments of the present disclosure, when the clock signals CK and XCK in FIG. 7 are used to drive the GOA circuit, the pull-down circuit unit 400 in the single-stage GOA circuit unit in FIG. 6 is input with the scan driving signal G(N+2) of the GOA circuit unit of next second stages, so as to maintain stability of the scan driving signal G(N) better. This situation will be explained by referring to FIG. 6 and FIG. 8.

Figure 8:
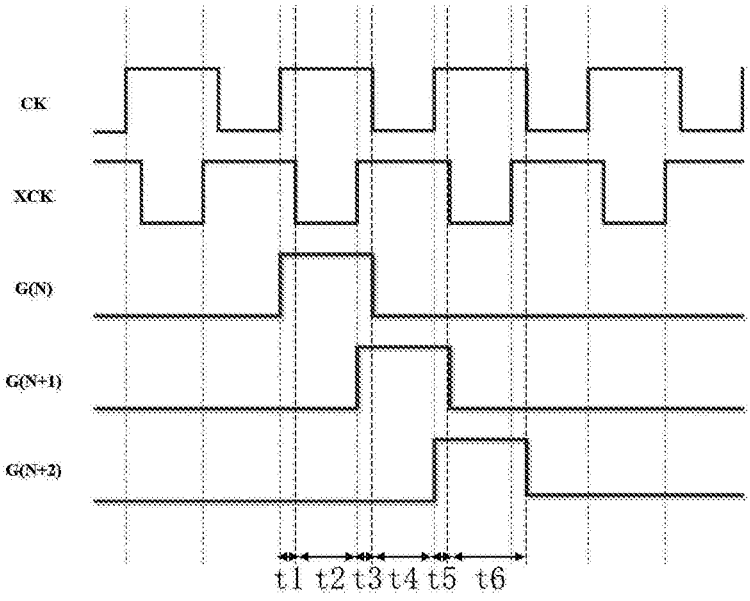
FIG. 8 is a signal waveform diagram of a single-stage GOA circuit unit in FIG. 6.

FIG. 8 is a signal waveform diagram of a single-stage GOA circuit unit in FIG. 6. FIG. 8 shows the clock signals CK and XCK, a scan outputting signal G(N) of the Nth stage of GOA circuit unit, a scan outputting signal G(N+1) of the (N+1)th stage of GOA circuit unit and a scan outputting signal G(N+2) of the (N+2)th stage of GOA circuit unit as shown in FIG. 7.

As stated above, when the first clock signal CK is input to the pull-up circuit unit 200 in the Nth stage of GOA circuit unit, the second clock signal XCK is input to the pull-up circuit unit 200 in the (N+1)th stage of GOA circuit unit, and the first clock signal CK is input to the pull-up circuit unit 200 in the (N+2)th stage of GOA circuit unit, and so on. Accordingly, referring to FIG. 8, in a scan outputting period, the scan outputting signal G(N) of the Nth stage of GOA circuit unit corresponds to the first clock signal CK, the scan outputting signal G(N+1) of the (N+1)th stage of GOA circuit unit corresponds to the second clock signal XCK, and the scan outputting signal G(N+2) of the (N+2)th stage of GOA circuit unit corresponds to first clock signal CK.

In the prior art, taking the Nth stage of GOA circuit unit as an example, generally the pull-down circuit unit 400 is input with the scan driving signal G(N+1) of the GOA circuit unit of the next stage, but such a driving method may cause instability of the scan outputting signal G(N).

In particular, in a scan outputting time period t1-t3, the pre-charging node Q(N) is at a high potential (not shown), the second thin film transistor T21 is turned on, and the scan outputting signal G(N) of the Nth stage of GOA circuit unit is at the high potential; in a reset time period t3-t5, since the scan outputting signal G(N+1) of the (N+1)th stage of GOA circuit unit is at the high potential, it will be transmitted to the pull-down circuit unit 400 in the Nth stage of GOA circuit unit, the fourth thin film transistor T31 will be turned on, thereby the low power voltage VSS will pull the scan outputting signal G(N) of the Nth stage of GOA circuit unit to the low potential through the fourth thin film transistor T31. It can be seen that in the time period t3, the second thin film transistor T21 and the fourth thin film transistor T31 both are turned on; at this time, the scan driving line of the Nth stage of GOA circuit unit will be input with the first clock signal CK at the high potential and the low power voltage VSS at the low potential simultaneously, and the simultaneous competition between the high potential and the low potential may cause instability of the scan outputting signal G(N).

In the exemplary embodiments of the present disclosure, as shown in FIG. 6, taking the Nth stage of GOA circuit unit as an example, the pull-down circuit unit 400 is inputted with the scan driving signal G(N+2) from the GOA circuit unit of next second stages (i.e., the (N+2)th stage). Such a driving method may avoid the problem "the simultaneous competition between the high potential and the low potential" effectively. In particular, in a scan outputting time period t1-t4, the pre-charging node Q(N) is at a high potential (not shown), the second thin film transistor T21 is turned on, the scan outputting signal G(N) of the Nth stage of GOA circuit unit corresponds to the first clock signal CK, firstly is at the high potential, and then is at the low potential; in a reset time period t5-t6, the scan outputting signal G(N+2) of the (N+2)th stage of GOA circuit unit is at the high potential, it is transmitted to the pull-down circuit unit 400 in the Nth stage of GOA circuit unit, the fourth thin film transistor T31 is turned on, thereby the low power voltage VSS pulls the scan outputting signal G(N) of the Nth stage of GOA circuit unit to be at the low potential through the fourth thin film transistor T31. It can be seen that the scan outputting time period t1-t4 is not overlapped with the reset time period t5-t6, and a situation that the high potential and the low potential are input to the scan driving line of the Nth stage of GOA circuit unit simultaneously will not occur. In a time period after the time period t6 (i.e., the low potential maintaining period), as stated above by referring to FIG. 6 and FIG. 7, the pull-down maintaining circuit units 501 and 502 work alternately to maintain the low potentials of the pre-charging node Q(N) and the scan driving signal G(N), which will not be repeatedly described again.

In summary, according to the exemplary embodiments of FIG. 6 and FIG. 8, there is provided a method of driving a liquid crystal panel including a GOA circuit.

Referring to FIG. 6, the GOA circuit of the liquid crystal panel including the GOA circuit according to the exemplary embodiments of the present disclosure includes a plurality of cascaded single-stage GOA circuit units, wherein each single-stage GOA circuit unit may include a pull-up control circuit unit 100, a pull-up circuit unit 200, a down-delivering circuit unit 300, a pull-down circuit unit 400, a bootstrap capacitor Cbt, a first pull-down maintaining circuit unit 501 and a second pull-down maintaining circuit unit 502. As shown in FIG. 6 and FIG. 8, the method includes: inputting a first clock signal CK to a first control terminal of the first pull-down maintaining circuit unit 501, inputting a second clock signal XCK to a second control terminal of the second pull-down maintaining circuit unit 502, and inputting the first clock signal CK and the second clock signal XCK alternately to the pull-up circuit unit 200 in the GOA circuit units of two adjacent stages; in a scan outputting time period (e.g., the time period t1-t4), the pull-up circuit unit 200 outputting the first clock signal CK or the second clock signal XCK to a scan driving line of the present stage to output a scan driving signal G(N); in a reset time period (e.g., the time period t5-t6), the pull-down circuit unit 400 be input with a scan driving signal G(N+2) from a GOA circuit unit of next second stages to reset potentials of the pre-charging node Q(N) and the scan driving signal G(N); in a low potential maintaining period (e.g., the time period after the time period t6), the first pull-down maintaining circuit unit 501 and the second pull-down maintaining circuit unit 502 work alternately to maintain the low potentials of the scan driving signal G(N) and the pre-charging node Q(N).

Since a timing of the first clock signal CK in FIG. 8 is consistent with a timing of the second clock signal XCK in FIG. 7, detailed depictions thereof will not be repeated.

In summary, each single-stage GOA circuit of the liquid crystal panel including the GOA circuit according to the exemplary embodiments of the present disclosure is input with a set of new clock signals CK and XCK, and the set of clock signals may satisfy signal requirements of the pull-up circuit unit, and may also replace control signals in the pull-down maintaining circuit unit, thereby using clock signal lines efficiently and saving the space occupied by wiring in a display panel efficiently. In addition, the liquid crystal panel including the GOA circuit according to the exemplary embodiments of the present disclosure also improves the input control signals of the pull-down circuit unit 400, and further improves stability of the scan outputting signal, to provide a new possibility for the design of the future GOA circuit.

In addition, except for the above GOA circuit, the liquid crystal panel according to the exemplary embodiments of the present disclosure may also include various elements such as a polariser, a light filter, a liquid crystal layer, a backlight module, and the like that are commonly seen in the art, which will be not expounded again here.

Although some exemplary embodiments of the present disclosure have been shown and described, it will be understood by those skilled in the art that amendments may be made to these exemplary embodiments without departing from the principle and spirit of the present disclosure of which the scope is defined by the attached claims and equivalents thereof.

What is claimed:

1. A liquid crystal panel comprising a GOA circuit, the GOA circuit comprising a plurality of cascaded single-stage GOA circuit units, wherein each single-stage GOA circuit unit comprises a pull-up control circuit unit, a pull-up circuit unit, a pull-down circuit unit, a bootstrap capacitor, a down-delivering circuit unit, a first pull-down maintaining circuit unit, and a second pull-down maintaining circuit unit, wherein in each single-stage GOA circuit unit, a first control terminal of the first pull-down maintaining circuit unit is configured to receive a first clock signal, a second control terminal of the second pull-down maintaining circuit unit is configured to receive a second clock signal, and the pull-down circuit unit is connected to a GOA circuit unit of a next second stage and wherein the pull-down circuit unit is configured to receive a scan driving signal from a GOA circuit unit of a next second stage, wherein the pull-up circuit units in GOA circuit units of two adjacent stages are configured to receive the first clock signal and the second clock signal alternately, wherein the first clock signal and the second clock signal have the same long period, and wherein the second clock signal delays with respect to the first clock signal, so that the second clock signal has a high potential at a first time period and a third time period within each high potential time period of the first clock signal, and has a low potential at a second time period between the first time period and the third time period.

2. The liquid crystal panel of claim 1, wherein the first pull-down maintaining circuit unit comprises:

a first inverter having a first input terminal, a first output terminal and a first control terminal, wherein the first input terminal is connected to a pre-charging node, and the first output terminal is connected to gates of a sixth thin film transistor and a seventh thin film transistor;

the sixth thin film transistor of which the gate is connected to a gate of the seventh thin film transistor, a drain is connected to a low power voltage line, and a source is connected to a scan driving line of the present stage; and the seventh thin film transistor of which the gate is connected to the gate of the sixth thin film transistor, a drain is connected to the low power voltage line, and a source is connected to the pre-charging node.

3. The liquid crystal panel of claim 2, wherein the second pull-down maintaining circuit unit comprises:

a second inverter including a second input terminal, a second output terminal and a second control terminal, wherein the second input terminal is connected to the pre-charging node, and the second output terminal is connected to gates of an eighth thin film transistor and a ninth thin film transistor;

the eighth thin film transistor of which the gate is connected to the gate of the ninth thin film transistor, a drain is connected to the low power voltage line, and a source is connected to the scan driving line of the present stage; and the ninth thin film transistor of which the gate is connected to the gate of the eighth thin film transistor, a drain is connected to the low power voltage line, and a source is connected to the pre-charging node.

4. The liquid crystal panel of claim 3, wherein the pull-down circuit unit comprises:

a fourth thin film transistor of which a gate is connected to a gate of a fifth thin film transistor and is configured to receive the scan driving signal from the GO A circuit unit of next second stage, a drain is connected to the low power voltage line, and a source is connected to the scan driving line of the present stage; and a fifth thin film transistor of which the gate is connected to the gate of a fourth thin film transistor and is configured to receive the scan driving signal from the GO A circuit unit of next second stage, a drain is connected to the low power voltage line, and a source is connected to the pre-charging node.

5. The liquid crystal panel of claim 1, wherein the pull-up circuit unit comprises:

a second thin film transistor of which a drain is connected to the down-delivering circuit unit and is configured to receive the first clock signal or the second clock signal, a gate is connected to a pre-charging node, and a source is connected to a scan driving line of the present stage to output a scan driving signal.

6. The liquid crystal panel of claim 1, wherein the down-delivering circuit unit comprises:

a third thin film transistor of which a drain is connected to the pull-up circuit unit and is configured to receive the first clock signal or the second clock signal, a gate is connected to a pre-charging node, and a source is connected to a stage-shift signal line of the present stage to output a stage-shift signal.

7. A method of driving a liquid crystal panel comprising the GOA circuit of claim 1, the method comprises comprising:

inputting a first clock signal to a first control terminal of the first pull-down maintaining circuit unit, inputting a second clock signal to a second control terminal of the second pull-down maintaining circuit unit, and inputting the first clock signal and the second clock signal alternately to the pull-up circuit units in GOA circuit units of two adjacent stages;

in a scan outputting time period, the pull-up circuit unit outputting the first clock signal or the second clock signal to a scan driving line of the present stage to output a scan driving signal;

in a reset time period, the pull-down circuit unit be input with a scan driving signal from a GOA circuit unit of next second stage to reset potentials of a pre-charging node and the scan driving signal;

in a low potential maintaining period, the first pull-down maintaining circuit unit and the second pull-down maintaining circuit unit work alternately to maintain low potentials of the scan driving signal and the pre-charging node, wherein the first clock signal and the second clock signal have the same long period, and wherein the second clock signal delays with respect to the first clock signal, so that the second clock signal has a high potential at a first time period and a third time period within each high potential time period of the first clock signal, and has a low potential at a second time period between the first time period and the third time period.

8. The method of claim 7, wherein for each period, the first time period is a start time period of the first clock signal and an end time period of a previous high potential time period of the second clock signal, the second time period is a middle time period of the first clock signal and a low potential time period of the second clock signal, and the third time period is an end time period of the first clock signal and a start time period of a next high potential time period of the second clock signal.

9. The method of claim 8, wherein a duty ratio of each of the first clock signal and the second clock signal is 60/40.

10. The method of claim 9, wherein the first time period and the third time period respectively occupy 10% of each period.

* * * * *